US008016160B2

(12) United States Patent
Kim et al.

(10) Patent No.: US 8,016,160 B2
(45) Date of Patent: Sep. 13, 2011

(54) REFRIGERATOR RELATED TECHNOLOGY

(75) Inventors: Dong Jeong Kim, Seoul (KR); Seong Jae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 819 days.

(21) Appl. No.: 12/016,257

(22) Filed: Jan. 18, 2008

(65) Prior Publication Data

US 2008/0174220 A1 Jul. 24, 2008

(51) Int. Cl.
*A47B 96/04* (2006.01)

(52) U.S. Cl. ..... 222/108; 222/146.6; 312/405; 312/405.1; 62/344; 62/389

(58) Field of Classification Search ..... 222/108, 222/146.6; D15/89–91; 312/405, 405.1; 62/344, 389

See application file for complete search history.

(56) References Cited

U.S. PATENT DOCUMENTS

| | | | | |
|---|---|---|---|---|
| 400,358 | A * | 3/1889 | Page | 222/108 |
| 1,895,859 | A | 1/1933 | Muffly | |
| 2,078,097 | A | 4/1937 | Radzinsky | |
| 2,126,491 | A | 8/1938 | McCartha | |
| 2,462,743 | A | 2/1949 | Handel | |
| 2,512,395 | A | 6/1950 | Sundberg | |
| 3,429,140 | A | 2/1969 | White | |
| 3,476,295 | A | 11/1969 | Telfer | |
| 3,747,363 | A | 7/1973 | Grimm | |
| 3,851,939 | A | 12/1974 | Benasutti | |
| 4,209,999 | A | 7/1980 | Falk | |
| 4,227,383 | A * | 10/1980 | Horvay | 62/344 |
| 4,252,002 | A | 2/1981 | Mullins, Jr. | |
| 4,284,212 | A | 8/1981 | Caswell | |
| 4,739,629 | A | 4/1988 | True | |
| 5,112,477 | A | 5/1992 | Hamlin | |
| 5,269,154 | A | 12/1993 | Schmidt | |
| 5,297,400 | A | 3/1994 | Benton | |
| 5,490,547 | A | 2/1996 | Abadi | |
| 5,542,265 | A | 8/1996 | Rutland | |
| 5,683,015 | A * | 11/1997 | Lee | 222/146.6 |
| 5,797,524 | A | 8/1998 | Lentz | |
| 5,827,428 | A * | 10/1998 | Chang | 210/248 |
| 5,927,557 | A | 7/1999 | Busick | |
| 5,956,967 | A | 9/1999 | Kim | |
| 5,960,995 | A * | 10/1999 | Leatherman et al. | 222/108 |

(Continued)

FOREIGN PATENT DOCUMENTS

DE 9215193 U1 1/1993

(Continued)

OTHER PUBLICATIONS

International Search Report and Written Opinion dated Oct. 23, 2008 for Application No. PCT/KR2008/000315, 7 pages.

(Continued)

*Primary Examiner* — Kevin P Shaver
*Assistant Examiner* — Donnell Long
(74) *Attorney, Agent, or Firm* — Fish & Richardson P.C.

(57) ABSTRACT

A refrigerator includes a dispenser to dispense water or ice, a door handle positioned below the dispenser, and a tray mounted to the door handle in a position to receive at least some water or ice dispensed from the dispenser. The tray coupled to the door handle attached to the door may receive excess or residue water or ice dispensed from the dispenser without deterioration of the exterior appearance of the door.

16 Claims, 9 Drawing Sheets

U.S. PATENT DOCUMENTS

| | | | | |
|---|---|---|---|---|
| 6,050,097 | A | 4/2000 | Nelson | |
| 6,082,130 | A | 7/2000 | Pastryk | |
| 6,101,835 | A | 8/2000 | Butsch | |
| 6,135,173 | A | 10/2000 | Lee | |
| 6,148,624 | A | 11/2000 | Bishop | |
| 6,286,324 | B1 | 9/2001 | Pastryk | |
| 6,314,745 | B1 | 11/2001 | Janke | |
| 6,351,958 | B1 | 3/2002 | Pastryk | |
| 6,595,021 | B2 | 7/2003 | Skinner | |
| 6,648,187 | B1 | 11/2003 | Shypkowski | |
| 6,651,449 | B2 | 11/2003 | Heims | |
| 6,679,082 | B1 | 1/2004 | Tunzi | |
| 7,007,500 | B2 | 3/2006 | Lee | |
| 7,316,121 | B2 | 1/2008 | Lee | |
| 7,343,757 | B2 * | 3/2008 | Egan et al. | 62/389 |
| 7,455,085 | B2 * | 11/2008 | Voglewede et al. | 141/360 |
| 7,543,897 | B2 * | 6/2009 | Kim | 312/405 |
| 2001/0030201 | A1 | 10/2001 | Gerhardt | |
| 2004/0182103 | A1 * | 9/2004 | Jung | 62/389 |
| 2005/0056043 | A1 | 3/2005 | Lee | |
| 2007/0033960 | A1 * | 2/2007 | Egan et al. | 62/389 |

FOREIGN PATENT DOCUMENTS

| | | | |
|---|---|---|---|
| EP | 0 449 061 | | 3/1991 |
| JP | 50-69644 | | 6/1975 |
| JP | 51-4116 | | 2/1976 |
| JP | 51-21164 | | 2/1976 |
| JP | 58-74086 | | 10/1989 |
| JP | 08-226735 | A | 9/1996 |
| JP | 2002-115960 | | 4/2002 |
| KR | 20-1985-0006891 | | 9/1985 |
| KR | 2001-0005331 | | 1/2001 |
| KR | 10-2001109423 | A | 12/2001 |
| KR | 10-2004013820 | A | 2/2004 |

OTHER PUBLICATIONS

Korean Notice of Allowance dated Nov. 14, 2007 for Application No. 10-2007-0005518, with English translation, 3 pages.

* cited by examiner

REFRIGERATOR RELATED TECHNOLOGY

CROSS REFERENCE TO RELATED APPLICATIONS

This application claims the benefit of Korean Patent Application No. 10-2007-0005518, filed on Jan. 18, 2007, which is hereby incorporated by reference for all purposes as if fully set forth herein.

BACKGROUND

1. Field of the Disclosure

The present disclosure relates to a refrigerator configured to capture water or ice dispensed from a dispenser.

2. Discussion of Related Art

Generally, a refrigerator is provided with a refrigerating compartment and a freezing compartment, and stores food therein. A refrigerating compartment is kept at a temperature of approximately 3° C. to 4° C. to store food in a fresh state for a prolonged period of time. A freezing compartment is kept at a temperature below zero to store food in a frozen state.

In addition to functions of refrigeration and freezing, a refrigerator may include a dispenser. The dispenser may be mounted to a door to enable a user to dispense water or ice.

SUMMARY

In one aspect, a refrigerator includes at least one door, and a dispenser positioned on the door and configured to dispense water or ice outside of the door. The refrigerator also includes a door handle provided below the dispenser, and a tray adapted to the door handle and positioned to receive water dispensed from the dispenser.

Implementations may include one or more of the following features. For example, the tray may be removably mounted to the door handle.

In some implementations, the tray may include a tray body supported by the door handle and configured to define a reservoir configured to receive and store water dispensed from the dispenser. The tray also may include a tray cover that is removably mounted to the tray body to cover the reservoir defined by the tray body. In these implementations, the tray body may include an upper body having a flange shape, and a lower body extending downward from the upper body. The lower body may define the reservoir configured to receive and store water dispensed from the dispenser. An amount of the lower body that extends downward from the upper body may be less than a thickness of the door handle, or an amount of the lower body that extends downward from the upper body may be substantially equal to a thickness of the door handle.

The tray cover may be formed with drain holes configured to allow water dispensed from the dispenser to pass into the reservoir defined by the tray body. In some examples, the refrigerator further may include a supporting block adapted to the door handle and configured to support a portion of the tray body. In these examples, a length of the door handle may be horizontally oriented such that the length of the door handle is substantially perpendicular to an access of rotation of the door, and the supporting block may be arranged perpendicular to the length of the door handle. An end of the door handle may be arranged parallel to the supporting block, and one end the tray may be supported by the supporting block and another end of the tray may be supported by the end of the door handle.

The tray may be adapted between a front surface of the door and the door handle, and the door handle, the tray, and the dispenser may be mounted to the door. In some arrangements, the door may be a first door. In these arrangements, the refrigerator may include a second door positioned below the first door on which the dispenser is positioned. The door handle and the tray may be positioned on the second door. The first door may be configured to open and close at least a portion of a refrigerating compartment and the second door may be configured to open and close at least a portion of a freezing compartment.

The tray may be mounted to the door handle in a sliding manner. The door handle may include a sliding groove into which a portion of the tray is inserted.

In some implementations, at least a portion of the dispenser may be configured for movement between a stored position and an operable position. In these implementations, the portion of the dispenser may be accommodated in the door when the dispenser is the stored position, and the portion of the dispenser may be positioned outside of a front surface of the door when the dispenser is in the operable position.

The tray may be positioned to receive ice dispensed from the dispenser. At least a portion of the tray may be mounted to the door handle in a manner such that the portion of the tray may be removed from the door handle by lifting the tray in a vertical direction.

In another aspect, a refrigerator includes a first door, and a second door that is different from the first door and positioned below the first door. The refrigerator also includes a dispenser positioned on the first door and configured to dispense water or ice outside of the first door, and a door handle attached to the second door. The door handle enables a user to open and close the second door. The refrigerator further includes a tray removably mounted to the door handle in a position to receive water dispensed from the dispenser.

DETAILED DESCRIPTION

Figure 1:
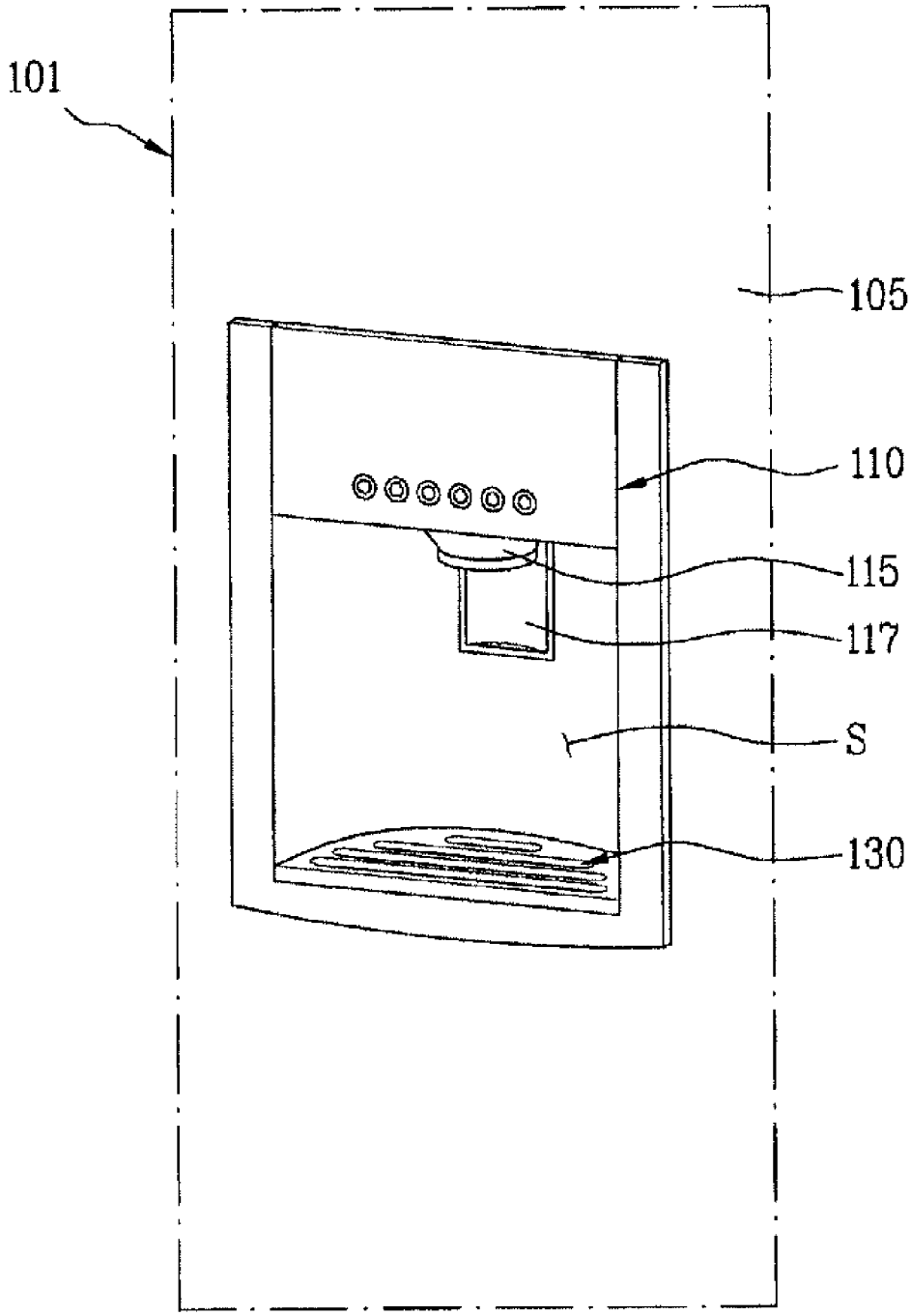
FIG. 1 is a partial perspective view illustrating a dispenser mounted to a door of a refrigerator.

FIG. 1 illustrates a dispenser mounted to a door of a refrigerator. As shown in FIG. 1, a refrigerator 101 with a dispenser 110 is structured such that the dispenser 110 is mounted to and recessed in a door 105. Therefore, a portion of the door 105 mounted with the dispenser 110 is depressed to define a cup receiving space S, into which a cup may be received.

A chute 115, through which water or ice may be dispensed, may be provided at an upper portion of the cup receiving space S. A lever 117 for controlling dispensing of water and/or ice through the chute 115 is provided proximate to the chute 115 on a rear portion of the dispenser housing that defines the cup receiving space S in the door 105. If the lever 117 is pushed by a cup received into the cup receiving space S, water or ice is dispensed through the chute 115.

A tray 130 is provided at a lower portion of the cup receiving space S. The tray 130 may be configured to support a cup placed thereon in the cup receiving space S and/or receive a residue of water or ice dispensed from the chute 115.

When the residue of water or ice is filled to a certain amount in the tray 130, the residue may be treated by removing the tray 130 from the cup receiving space S and then emptying the residue. Thereafter, the tray 130 may be mounted again in the cup receiving space S.

In a structure in which the tray is mounted in the lower portion of the cup receiving space, an inner space of the door may be decreased due to the volume or size of the tray and the cup receiving space.

Figure 2:
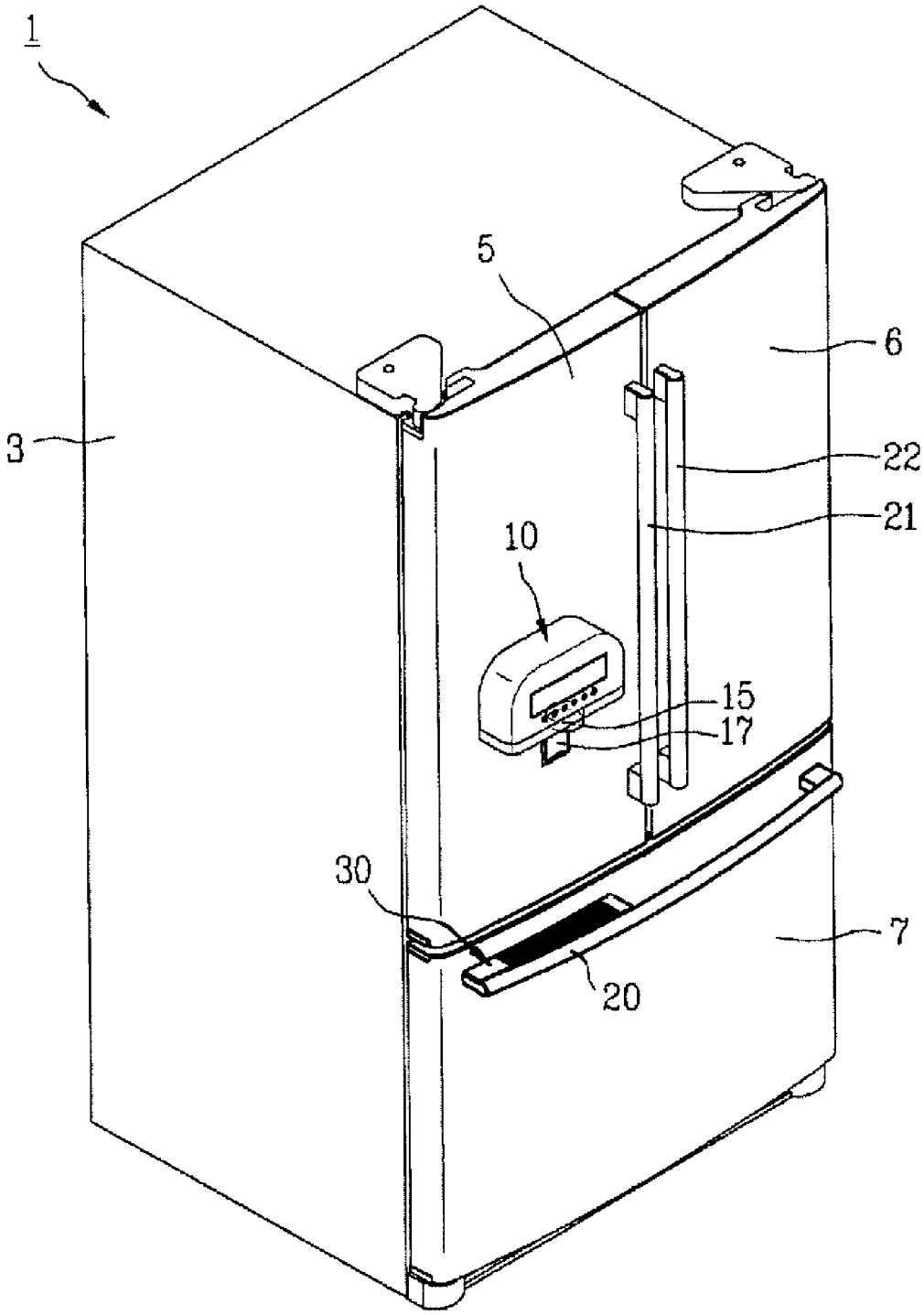
FIG. 2 is a perspective view of a refrigerator including a dispenser and a tray.
Figure 3:
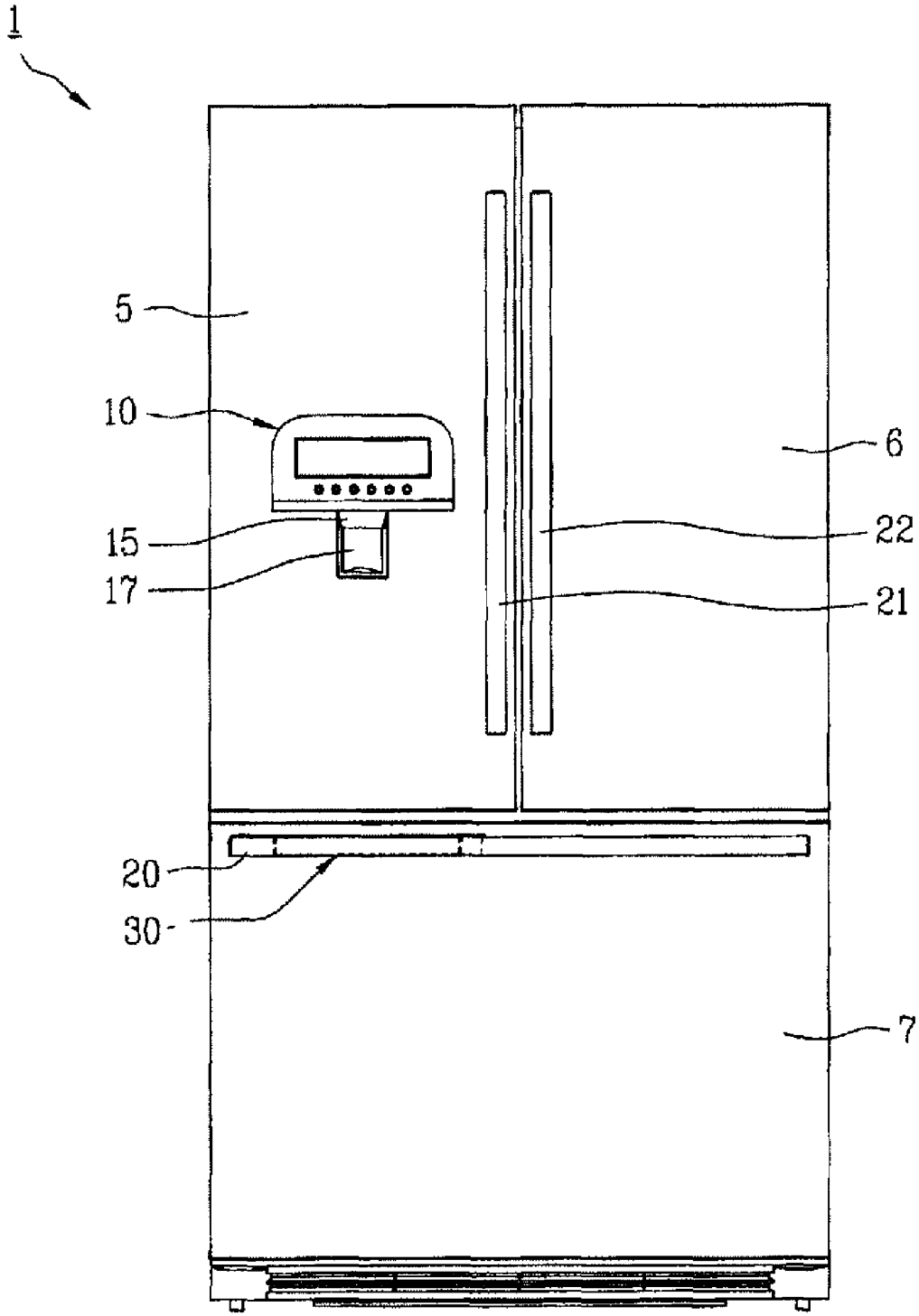
FIG. 3 is a front view of the refrigerator shown in FIG. 2.

FIG. 2 shows a refrigerator including a dispenser and a tray, and FIG. 3 shows a front of the refrigerator shown in FIG. 2.

As shown in FIGS. 2 and 3, a refrigerator 1 includes a main body 3 forming a food storage space, and a door 5 for opening and closing a portion of the space of the main body 3. A dispenser 10 is mounted to the door 5, and a tray 30 is mounted to a door handle 20.

The food storage space of the main body 3 is divided into a refrigerating compartment and a freezing compartment. In order to open and close the respective spaces of the refrigerating compartment and the freezing compartment, three doors 5, 6, and 7 are attached to the main body 3. In this example, doors 5 and 6 are configured to open and close the refrigerating compartment formed at a relatively upper portion of the main body 3, and the door 7 is configured to open and close the freezing compartment formed at a relatively lower portion of the main body 3

Door handles 20, 21 and 22 are attached to the doors 7, 5, and 6, respectively. The door handles 20, 21, and 22 are attached to portions near side edges of the respective doors 7, 5, and 6 to enable opening and closing of the doors 7, 5, and 6.

The door handles 20, 21, and 22 may be formed in a shape that enables a user to easily grip the door handles 20, 21 and 22 when the user intends to open or close the doors 7, 5, and 6.

As shown in FIGS. 2 and 3, each of the door handles 20, 21, and 22 may have a shape such that both end portions of the handles attach to each of the doors 7, 5, and 6, respectively, and a longitudinal body extends between the end portions. The longitudinal body may be attached or integrally formed with the end portions such that the longitudinal body is spaced apart from an outer surface of the doors 5, 6 and 7.

The door handles 20, 21, and 22 are attached to the doors 7, 5, and 6, securely enough to endure forces corresponding to opening and closing the doors 7, 5, and 6. Accordingly, the user may easily open or close the doors 7, 5, and 6 using the respective door handles 20, 21 and 22.

The dispenser 10 is configured to dispense water or ice. In this example, the dispenser 10 is mounted on an outer surface of the door 5. The dispenser 10 includes a cover or casing which forms an external surface of the dispenser 10. The cover or casing may be provided with operation buttons for selectively dispensing water or ice and a display part for displaying an operating state of the refrigerator 1 or dispenser 10.

The dispenser 10 further includes a chute 15 extending from or provided in an interior of the cover or casing, through which water or ice is dispensed, and a lever 17 provided on the refrigerator door 5 and positioned lower than the chute 15. The lever 17 is configured to control dispensing of ice and/or water through the chute 15. If the lever 17 is pushed by a cup or other object, water or ice is dispensed through the chute 15.

In some implementations, the dispenser 10 may include two chutes arranged apart from each other with one chute configured to dispense water and the other chute configured to dispense ice. However, as described above, the dispenser 10 may be capable of dispensing water or ice through the single chute 15.

The refrigerator 1 further includes a tray 30 mounted to the door handle 20 of the door 7. The tray 30 may be mounted to the door handle 20 such that the tray may be removed from the door handle 20 and may be positioned below the dispenser 10. In some implementations, the tray 30 also may be positioned such that the tray 30 is arranged under the chute 15. In these implementations, the tray 30 receives a residue of water or ice dispensed from the dispenser 10 or excess water or ice dispensed from the dispenser 10 and not received in a container. The tray 30 may be provided on an upper surface of the door handle 20.

In some arrangements, the tray 30 may be removably attached to the door handle 20 in such a manner that the tray 30 is placed on or attached to the door handle 20 in the vertical down direction and is removed from the door handle 20 in the vertical up direction. Enabling removal of the tray 30 in the vertical up direction in front of an outer surface of a refrigerator door may allow a user to easily remove the tray without spilling water or ice received in the tray 30.

Because the tray 30 is attached to the existing door handle 20 of the door 7, the aesthetic appearance of the exterior of the door 7 may not be impacted when viewed from the front as shown in FIG. 3.

Further, because the door handle 20 is attached to the door 7 securely enough to open and close the door 7, the tray 30 may stably support a cup or other relatively heavy object when placed on the tray.

As described above, the tray 30 may be configured to receive a residue of water or ice dispensed from the dispenser 10. Because the tray 30 is removably attached to the door handle 20, if the tray 30 becomes filled with water or ice, a user may remove the tray 30 from the door handle 20 and dispose of the water or ice.

Figure 4:
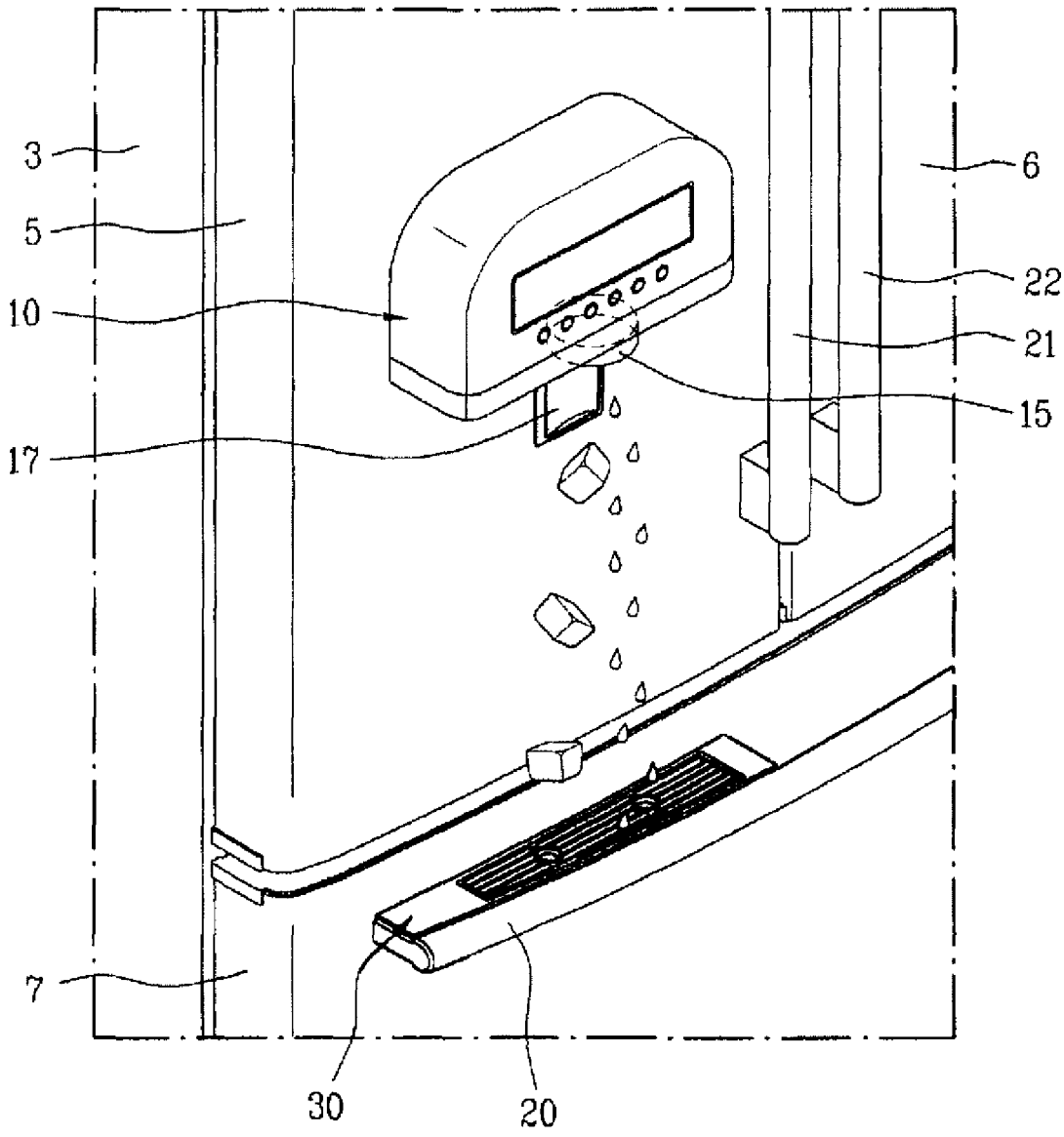
FIG. 4 is a partial perspective view of a refrigerator illustrating a region near the tray shown in FIG. 2.

FIG. 4 illustrates a region of a refrigerator near the tray 30 shown in FIG. 2. As shown in FIG. 4, the tray 30 is mounted to the door handle 20 and positioned below the dispenser 10. The tray 30 may removably mounted to the door handle region.

Accordingly, the tray 30 may be positioned below the dispenser 10 and under the chute 15 to enable the tray 30 to receive water or ice dispensed from the dispenser 10. The tray 30 may prevent water or ice from dropping to the exterior of the refrigerator 1. For example, the tray 30 may prevent excess water or ice from dropping to a floor on which the refrigerator 1 sits. The excess water or ice may be water or ice spilled when attempting to fill a container or may be residual water or ice dispensed by the dispenser 10 after a user has moved a container, which the user filled with water or ice.

Figure 5:
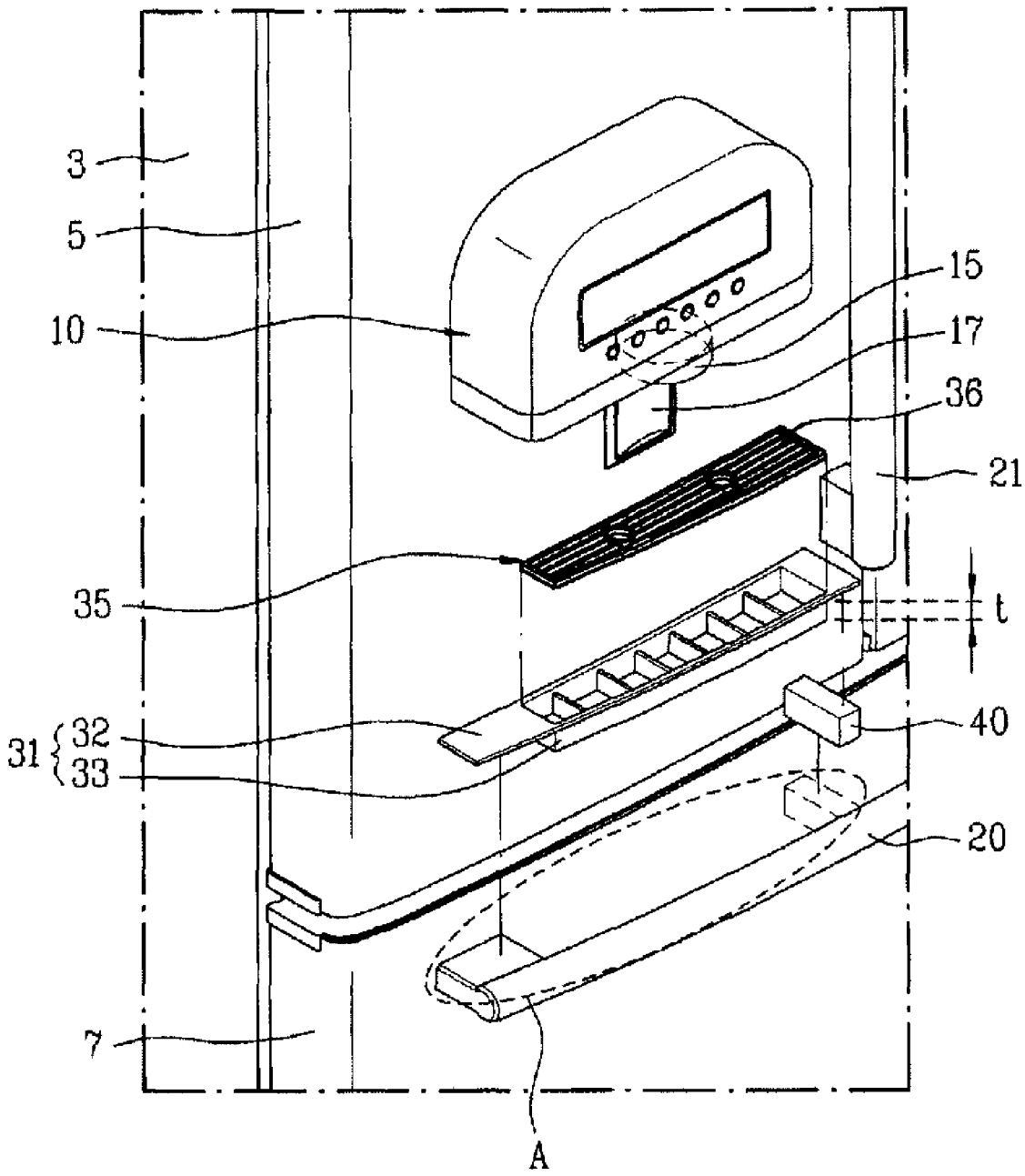
FIG. 5 is an exploded perspective view of the tray shown in FIG. 4.

FIG. 5 illustrates the tray shown in FIG. 4. As shown in FIG. 5, the tray 30 includes a tray body 31, and a tray cover 35 configured to cover the tray body 31. As shown in FIG. 5, the tray 30 may be removably mounted in a door handle region A. The region A may be a region that includes an edge of the door handle 20.

The tray body 31 is supported by the door handle 20, and positioned to receive a residue of water or ice dispensed from the dispenser 10. The tray body 31 includes an upper body 32, which is supported by the door handle 20, and a lower body 33, which defines a recess or container in which water or ice is received.

The upper body 32 may be formed in a flange shape, such that the tray body 31 may be supported on an upper surface of the door handle 20. In other words, the upper body 32 may have a shape corresponding to the upper surface of the door handle 20 to enable mounting to and removal from the upper surface of the door handle 20.

The lower body 33 has a shape that defines a recess in the tray body 31 with a thickness t from the upper body 32. The thickness t may correspond to the thickness of the door handle 20. Therefore, as shown in FIG. 3, when the tray body 31 is attached to the door handle 20, the tray body 31 does not affect the exterior appearance of the door 7 when viewed from the front of the refrigerator 1.

The upper body 32 and the lower body 33 may be integrally formed, or may be separately fabricated and assembled to form the tray body 31.

In implementations in which the upper body 32 and the lower body 33 are separately fabricated, the upper body 32 and the lower body 33 may be fabricated in a shape corresponding to the shape of the door handle 20, and then assembled with each other to be mounted to the door handle 20.

The tray cover 35 may be removably attached to the tray body 31, and may cover at least a portion of the tray body 31. For instance, the tray cover 35 may cover an opening of the recess defined by the lower body 33. The tray cover 35 may be formed with drain holes 36, through which water or ice may be received into the tray body 31. In some implementations, the drain holes 36 may be of a size that is less than a size of a typical ice cube. In these implementations, the tray cover 35 may support an ice cube dispensed from the dispenser 10 and allow water from the ice cube to be received into the tray body 31 as the ice cube melts.

The tray cover 35 also may support a cup or another container. Placing a cup on the tray cover 35 of the tray 30 supported by the door handle 20 may allow a user to easily fill the cup with water or ice dispensed from the chute 15.

As described above, because the door handle 20 is attached to the door 7 securely enough to open and close the door 7, the tray 30 mounted to the door handle 20 may stably support a cup or other relatively heavy object when placed on the tray 30.

The refrigerator 1 further includes a supporting block 40 configured to support a portion of the upper body 32 of the tray body 31 when the tray 30 is mounted to the door handle 20.

As shown in FIG. 5, the supporting block 40 is attached between the inner surface of the door handle 20 in the door handle region A and the outer surface of the door 7. In this example, the supporting block 40 is formed in a substantially rectangular shape, and is arranged parallel with the edge of the door handle 20, on which a portion of the upper body 32 rests. However, the shape of the supporting block 40 is not limited to the rectangular shape, and may be changed.

Also, the supporting block 40 may be removably attached to the door handle 20 and the door 7, or may be more securely attached to the door handle 20 and the door 7 by use of an adhesive agent, bolts or other type of fastening mechanism. The supporting block 40 also may be integrally formed with one or both of the door handle 20 and the door 7.

The supporting block 40 being mounted in the door handle region A enables the tray 30 to be stably mounted to the door handle 20. For example, the supporting block 40 provides a second surface on which the tray body 31 rests and the supporting block 40 and the door handle 20 limit horizontal movement of the tray body 31 by defining a cavity into which the lower body 33 resides when the tray body 31 is attached to the door handle 20.

Because the tray 30 is mounted to the existing door handle 20, the tray 30 may be convenient to use, and the tray 30 may not impact the exterior appearance of the door 7 when viewed from the front.

Figure 6:
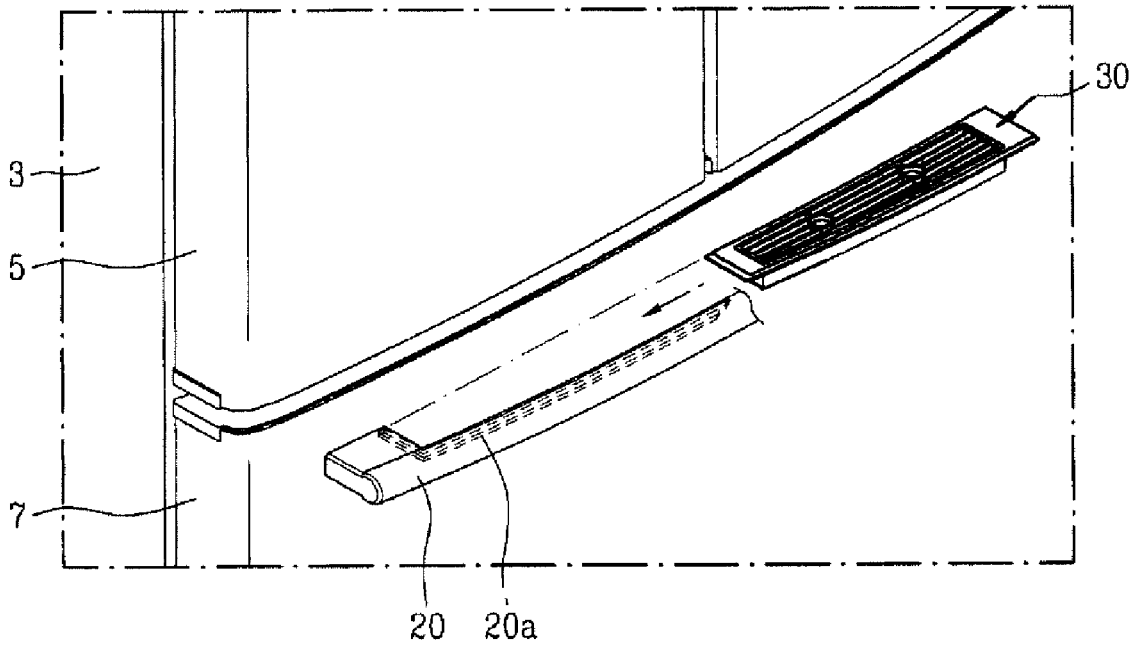
FIG. 6 is a partial perspective view of a refrigerator including a tray.

FIG. 6 illustrates a refrigerator including a tray. The features of the refrigerator shown in FIG. 6 that are the same as features described above are referenced by the same reference numerals. Therefore, further description of those features is not provided.

As shown in FIG. 6, the refrigerator includes the tray 30, which is removably mounted to the door handle 20. In these implementations, the tray 30 has a structure such that the tray 30 is attached to the door handle 20 in a sliding manner.

To this end, the inner surface of the door handle 20 is formed with a sliding groove 20*a*. The sliding groove 20*a* may have a shape of being depressed from the inner surface of the door handle 20 so that the upper body 32 (refer to FIG. 5) of the tray 30 may be fitted into the sliding groove 20*a*.

Accordingly, the tray 30 is removably attached to the door handle 20 by sliding an edge of the upper body 32 of the tray 30 along the sliding groove 20*a*. As discussed above, the tray 30 may be mounted to the door handle 20 and positioned below the dispenser 10 (refer to FIG. 5) to receive a residue of water or ice dispensed from the dispenser 10.

When the tray 30 is filled with water or ice, a user may remove the tray 30 from the door handle 20 by sliding the tray 30 in the reverse direction. Once removed, the user may empty the water or ice from the tray 30. Thereafter, the user may attach the emptied tray 30 again to the door handle 20 by sliding the tray back 30 into the groove 20*a*.

Because the tray 30 is mounted to the existing door handle 20, the tray 30 may be convenient to use, and the tray 30 may not impact the exterior appearance of the door 7 when viewed from the front.

Further, because the door handle 20 is attached to the door 7 securely enough to open and close the door 7, the tray 30, when slid into the groove 20*a*, may stably support a cup or other relatively heavy object.

Figure 7:
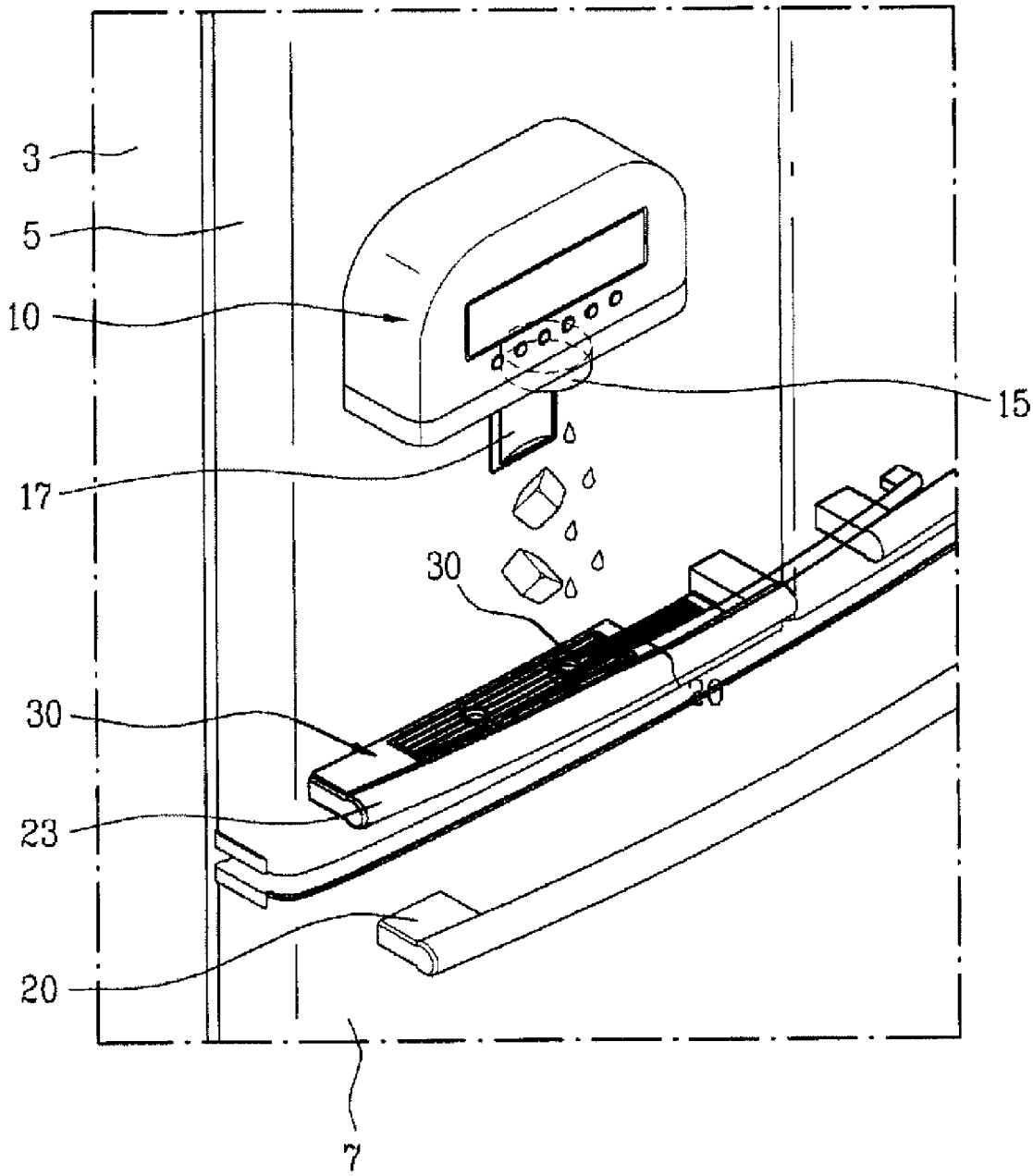
FIG. 7 is a partial perspective view of a refrigerator including a dispenser and a tray.

FIG. 7 illustrates a refrigerator including a dispenser and a tray. The features of the refrigerator shown in FIG. 7 that are the same as features described above are referenced by the same reference numerals. Therefore, further description of those features is not provided.

As shown in FIG. 7, the refrigerator includes a tray 30, which is mounted to a door handle. In the implementations described above, the tray 30 was described as being mounted to the door handle 20 attached to the door 7 provided below the door 5 mounted with the dispenser 10. In this implementation, the tray 30 is attached to a door handle 23 attached to the door 5 mounted with the dispenser 10.

The tray 30 may be attached to the door handle 23 using techniques described above with respect to attaching the tray 30 to the door handle 20. For example, the tray 30 may be placed on the door handle 23 as described with respect to FIGS. 2-5. As described with respect to FIG. 6, the tray 30 also may be attached to the door handle 23 by sliding the tray 30 into a groove formed in the door handle 23.

Although the present disclosure has described refrigerators having three doors, the described techniques also may be applied to refrigerators having a different number of doors, such as one or two doors.

In addition, although the present disclosure has described refrigerators having the dispenser mounted on the outer surface of a door, the described techniques also may be applied to a refrigerator having a dispenser which is accommodated in and drawn out of the door.

Figure 8:
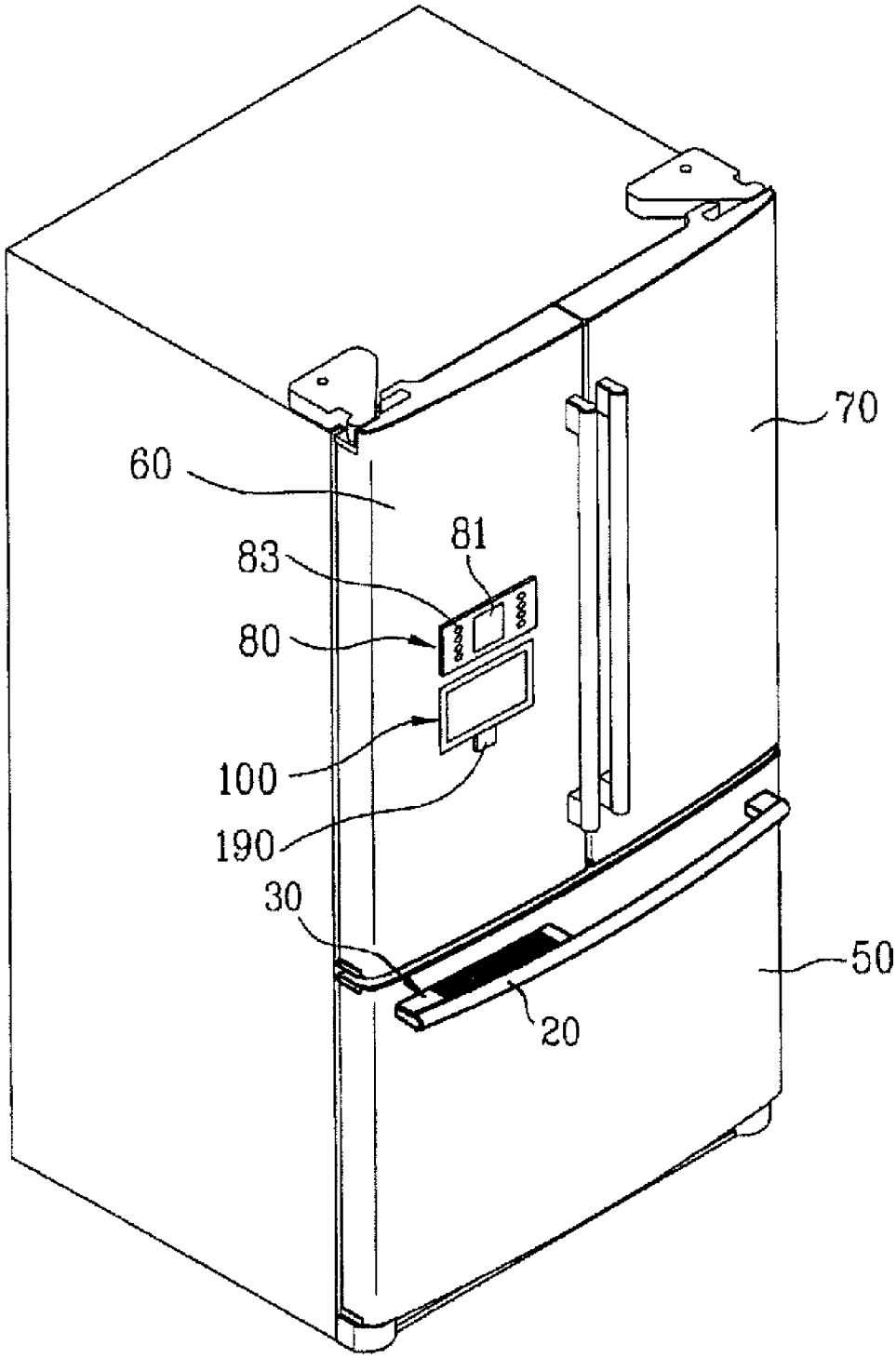
FIG. 8 is a perspective view of a refrigerator including a dispenser and a tray.
Figure 9:
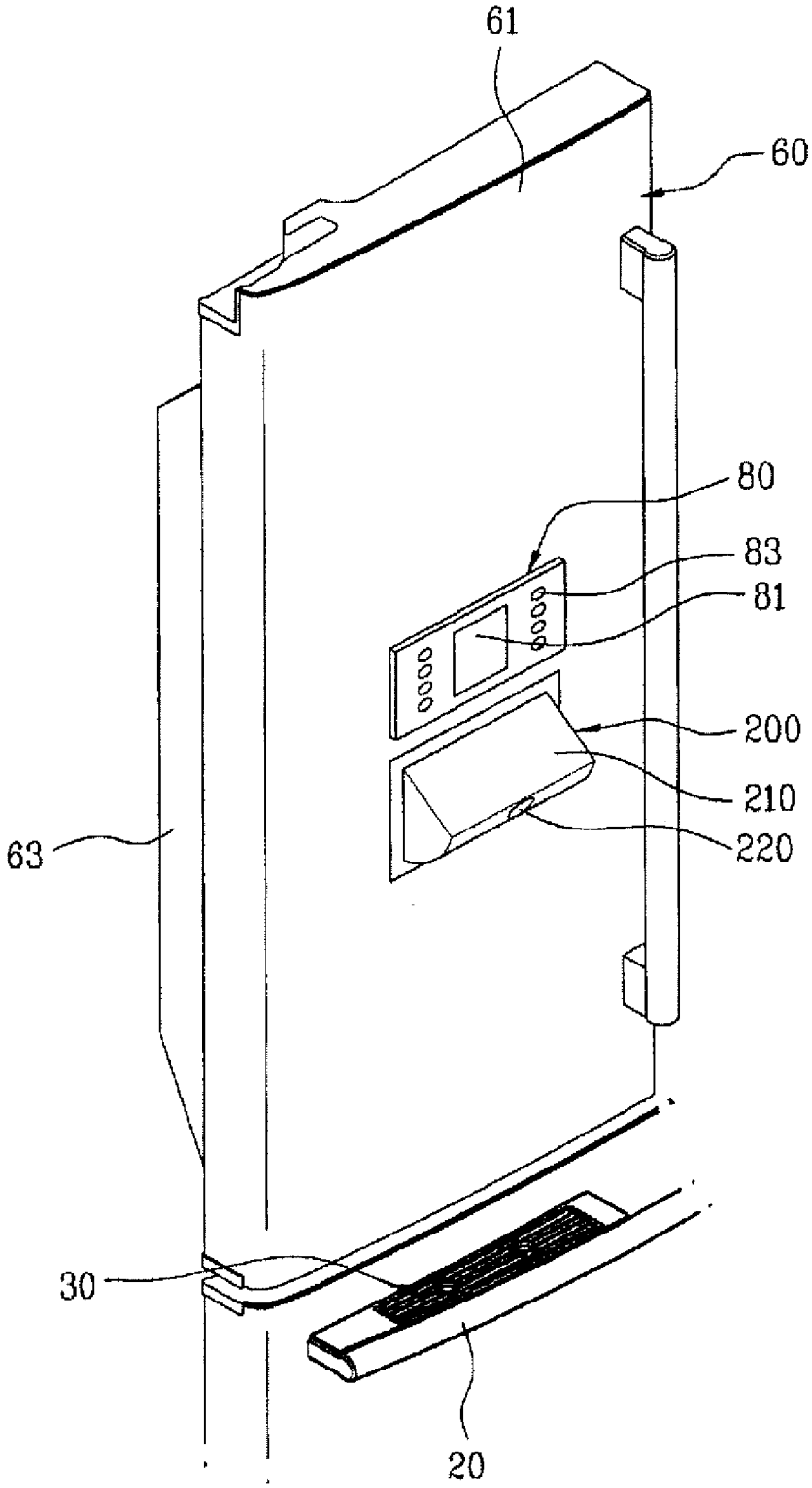
FIG. 9 is a partial perspective view illustrating the refrigerator shown in FIG. 8 when the dispenser is in a position to dispense water or ice.

FIGS. 8 and 9 illustrate a refrigerator including a tray and a dispenser that includes a rotatably mounted dispensing assembly. The refrigerator includes a refrigerating compartment formed at a relatively upper portion of the refrigerator and a freezing compartment formed at a relatively lower portion of the refrigerator. The refrigerator also includes refrigerator doors 60 and 70, which are configured to open and close the refrigerating compartment, and freezer door 50, which is configured to open and close the freezing compartment.

A dispenser 100 for dispensing content, such as water or ice, is mounted to a front surface of a door 60 of a refrigerating compartment. Above the dispenser 100 is mounted a control panel 80, which includes buttons 83 for controlling operation of the dispenser. The control panel 80 further may include a display part 81 for displaying refrigerator or dispenser operation information. The refrigerator also may include a pad 190 provided on an outer surface of the door 60. The pad 190 may reduce damage to the door 60 when a user positions a container under the dispenser 100 for receiving ice or water.

The dispenser 100 mounted to the door 60 of the refrigerating compartment includes a moving chute which may be drawn out of the door from an inner space of the door to dispense water or ice. For example, the moving chute may be part of a dispensing housing or assembly configured to rotate from a stored or closed position in which the dispenser assembly is positioned within the door 60 to an operable or open position in which the dispensing housing or assembly is positioned outside of the door 60. As shown in FIG. 8, the dispensing housing or assembly is in the stored or closed position.

As shown in FIG. 9, the door 60 of the refrigerating compartment includes a front frame 61 and a rear frame 63. When the door 60 is attached to the refrigerator and in a closed position, a part of the front frame 61 is exposed to the outside of the refrigerator, and a part of the rear frame 63 is exposed to an interior of the main body of the refrigerator.

The front frame 61 and the rear frame 63 define a space in the door 60. An ice making device (not shown) configured to communicate with a freezing compartment and make ice, an ice container (not shown) configured to store the ice made by the ice making device, and a water tank (not shown) configured to store water may be mounted in the space defined in the door 60. In some implementations, the ice making device, the ice container, and the water tank may be mounted in the main body of the refrigerator, or may be mounted in the door of the freezing compartment.

The dispenser 200 for dispensing water or ice may be mounted in the space defined in the door 60 by the front frame 61 and the rear frame 63. The dispenser 200 may be connected with the water tank and the ice container to facilitate water and ice dispensing, respectively.

The dispenser 200 includes a moving chute 220 and a dispensing cover 210. When the dispenser 200 is in an operable position in which water or ice may be dispensed, at least a portion of the moving chute 220 is drawn out of the front frame 61 exterior to the door 60. In the operable position, the moving chute 220 forms a passage for dispensing water and/or ice. When the dispenser 200 is in a stored position in which water or ice may not be dispensed, the moving chute 220 is accommodated in the space defined between the front frame 61 and the rear frame 63. The dispensing cover 210 may be drawn out of the front frame 61 together with the moving chute 220 when the dispenser 200 rotates from the stored position to the operable position. In some implementations, in the stored position, the dispensing cover 210 may rest against the door 60 or may be positioned in a plane parallel to the outer surface of the door 60. In these implementations, the dispensing cover 210 may cover the opening of the space defined in the door 60 by the front frame 61 and the rear frame 63.

The dispensing cover 210 and the moving chute 220 may be integrally formed. The dispensing cover 210 and the moving chute 220 may form a dispensing housing or dispensing assembly. More particularly, in some implementations, the dispensing cover 210 forms an exterior appearance of the dispensing housing, and the moving chute 220 forms the interior of the dispensing housing. Accordingly, the dispensing cover 210 and the moving chute 220 move together, and the moving chute 220 is accommodated in and drawn out of the door 60 as the dispensing housing moves between the stored position and the operable position. The moving chute 220 may be provided with an ice dispensing hole (not shown) at an end, through which ice is dispensed.

In some examples, the refrigerator further may include a water dispensing duct (not shown) which is attached to the dispensing cover 210 and configured to dispense water. In these examples, the water dispensing duct communicates with the water tank, and a discharge hole (not shown) of the water dispensing duct is positioned at a lower surface of the dispensing cover 210.

When the dispensing cover 210 and the moving chute 220 are drawn out of the front frame 61 in order to dispense water (e.g., the dispensing housing is in the operable position), the water dispensing duct (not shown) attached to the dispensing cover 210 also moves together with the dispensing cover 210 and the moving chute 220. In the operable position, water may be dispensed through the discharge hole of the water dispensing duct.

As a result, if the user pushes a button for dispensing water or ice, while the dispensing cover 210 is drawn out of the front frame 63 (e.g., the dispensing housing is in the operable position), ice may be dispensed through the ice dispensing hole of the moving chute 220, and water may be dispensed through a discharge hole of the water dispensing duct.

After ice and/or water is dispensed through the dispensing hole of the moving chute 220 or the discharge hole of the water dispensing duct, is the ice and/or water may be received in the tray 30 mounted to the door handle 20 attached to the door of the freezing compartment. The structure of the tray 30 may be substantially the same as described above with respect to FIGS. 2-7.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

at least one door;

a dispenser that is positioned on the door and that protrudes from the door at least when dispensing water or ice outside of the door;

a door handle provided below the dispenser;

a tray mounted between a front surface of the door and the door handle and positioned to receive water dispensed from the dispenser, wherein the tray includes a tray body supported by the door handle and configured to define a reservoir configured to receive and store water dispensed from the dispenser, and a tray cover that is removably mounted to the tray body to cover the reservoir defined by the tray body; and a supporting block adapted to the door handle and configured to support a portion of the tray body, wherein a length of the door handle is horizontally oriented such that the length of the door handle is substantially perpendicular to an access of rotation of the door, wherein the supporting block is arranged perpendicular to the length of the door handle, wherein an end of the door handle is arranged parallel to the supporting block, and wherein one end of the tray is supported by the supporting block and another end of the tray is supported by the end of the door handle.

2. The refrigerator according to claim 1, wherein the tray is removably mounted to the door handle.

3. The refrigerator according to claim 1, wherein the tray body includes an upper body having a flange shape, and a lower body extending downward from the upper body, the lower body defining the reservoir configured to receive and store water dispensed from the dispenser.

4. The refrigerator according to claim 3, wherein an amount of the lower body that extends downward from the upper body is less than a thickness of the door handle.

5. The refrigerator according to claim 3, wherein an amount of the lower body that extends downward from the upper body is substantially equal to a thickness of the door handle.

6. The refrigerator according to claim 1, wherein the tray cover is formed with drain holes configured to allow water dispensed from the dispenser to pass into the reservoir defined by the tray body.

7. The refrigerator according to claim 1, wherein the door handle, the tray, and the dispenser are mounted to the door.

8. The refrigerator according to claim 1, wherein the door is a first door, further comprising:

a second door positioned below the first door on which the dispenser is positioned, the door handle and the tray being positioned on the second door.

9. The refrigerator of claim 8 wherein the first door is configured to open and close at least a portion of a refrigerating compartment and the second door is configured to open and close at least a portion of a freezing compartment.

10. The refrigerator according to claim 1, wherein the tray is mounted to the door handle in a sliding manner.

11. The refrigerator according to claim 10, wherein the door handle includes a sliding groove into which a portion of the tray is inserted.

12. The refrigerator according to claim 1, wherein:

at least a portion of the dispenser is configured for movement between a stored position and an operable position, the portion of the dispenser being accommodated in the door when the dispenser is the stored position, and the portion of the dispenser being positioned outside of a front surface of the door when the dispenser is in the operable position.

13. The refrigerator according to claim 1, wherein the tray is positioned to receive ice dispensed from the dispenser.

14. The refrigerator according to claim 1, wherein at least a portion of the tray is mounted to the door handle in a manner such that the portion of the tray may be removed from the door handle by lifting the tray in a vertical direction.

15. A refrigerator comprising:

a first door;

a second door that is different from the first door and positioned below the first door;

a dispenser positioned on the first door and configured to dispense water or ice outside of the first door;

a door handle attached to the second door, the door handle enabling a user to open and close the second door;

a tray removably mounted between a front surface of the door and the door handle in a position to receive water dispensed from the dispenser, wherein the tray includes a tray body supported by the door handle and configured to define a reservoir configured to receive and store water dispensed from the dispenser, and a tray cover that is removably mounted to the tray body to cover the reservoir defined by the tray body; and a supporting block adapted to the door handle and configured to support a portion of the tray body, wherein a length of the door handle is horizontally oriented such that the length of the door handle is substantially perpendicular to an access of rotation of the door, wherein the supporting block is arranged perpendicular to the length of the door handle, wherein an end of the door handle is arranged parallel to the supporting block, and wherein one end of the tray is supported by the supporting block and another end of the tray is supported by the end of the door handle.

16. A refrigerator comprising:

at least one door;

a dispenser that is positioned on the door and that protrudes from the door at least when dispensing water or ice outside of the door; and means for enabling a user to open and close a door of the refrigerator and supporting a tray configured to receive water dispensed from the dispenser, wherein the tray includes a tray body supported by the means and configured to define a reservoir configured to receive and store water dispensed from the dispenser, and a tray cover that is removably mounted to the tray body to cover the reservoir defined by the tray body; and a supporting block adapted to the means and configured to support a portion of the tray body, wherein a length of the means is horizontally oriented such that the length of the means is substantially perpendicular to an access of rotation of the door, wherein the supporting block is arranged perpendicular to the length of the means, wherein an end of the means is arranged parallel to the supporting block, and wherein one end of the tray is supported by the supporting block and another end of the tray is supported by the end of the means.

* * * * *